US007416028B2

(12) United States Patent
Prendin et al.

(10) Patent No.: US 7,416,028 B2
(45) Date of Patent: Aug. 26, 2008

(54) TELEMETRY SYSTEM FOR THE BI-DIRECTIONAL COMMUNICATION OF DATA BETWEEN A WELL POINT AND A TERMINAL UNIT SITUATED ON THE SURFACE

(75) Inventors: Walter Prendin, Chirignago-Venezia (IT); Danilo Maddalena, Venezia (IT); Gilberto Toffolo, San Foca-Pordenone (IT); Francesco Donati, Milan (IT)

(73) Assignees: ENI S.p.A., Rome (IT); Tecnomare S.p.A., Venezia (IT)

( * ) Notice: Subject to any disclaimer, the term of this patent is extended or adjusted under 35 U.S.C. 154(b) by 249 days.

(21) Appl. No.: 10/511,263

(22) PCT Filed: Jan. 28, 2003

(86) PCT No.: PCT/EP03/00746

§ 371 (c)(1),
(2), (4) Date: Mar. 25, 2005

(87) PCT Pub. No.: WO03/089760

PCT Pub. Date: Oct. 30, 2003

(65) Prior Publication Data

US 2005/0161231 A1 Jul. 28, 2005

(30) Foreign Application Priority Data

Apr. 22, 2002 (IT) ..... MI2002A0853
Nov. 4, 2002 (IT) ..... MI2002A2331

(51) Int. Cl.
*E21B 23/14* (2006.01)
*E21B 44/00* (2006.01)
*E21B 47/12* (2006.01)

(52) U.S. Cl. ..... 166/381; 166/385; 166/66; 166/77.1; 340/853.1; 340/854.1

(58) Field of Classification Search ..... 166/242.6, 166/77.1, 385, 250.01, 381, 66; 340/853.1, 340/852, 854.1, 855.4, 853.9
See application file for complete search history.

(56) References Cited

U.S. PATENT DOCUMENTS 3,904,840 A 9/1975 Kostelnicek (Continued)

FOREIGN PATENT DOCUMENTS

EP 0 553 732 8/1993

(Continued)

*Primary Examiner*—Shane Bomar
(74) *Attorney, Agent, or Firm*—Oblon, Spivak, McClelland, Maier & Neustadt, P.C.

(57) ABSTRACT

A telemetry system for bi-directional communication of data between a well point and a terminal unit situated on a surface, which can be used inside drilling or production strings. The system includes data transmission and optional reception devices. An active vehicle, which can be equipped with plural automation levels, ranging from purely tele-operated to completely autonomous, is provided for unwinding and pulling a connection line, capable of moving inside a drilling or production string, or a passive vehicle, moved by a deploying cable and a suitable winding/unwinding device, in particular a winch. A connection line, containing electric conductors and/or one or more optical fibers of the transmission and optional reception devices is provided between a well point and its corresponding point situated inside the vehicle or on the surface.

27 Claims, 5 Drawing Sheets

U.S. PATENT DOCUMENTS 5,142,990 A 9/1992 Leonard
5,521,337 A * 5/1996 Chen et al. ..... 181/102
5,833,015 A 11/1998 Hesse et al.
6,041,872 A 3/2000 Holcomb
6,655,453 B2 * 12/2003 Head ..... 166/77.1
2005/0156754 A1 * 7/2005 Rodney ..... 340/853.3

FOREIGN PATENT DOCUMENTS

GB 2 370 590 7/2002
WO 98/12418 3/1998

* cited by examiner

TELEMETRY SYSTEM FOR THE BI-DIRECTIONAL COMMUNICATION OF DATA BETWEEN A WELL POINT AND A TERMINAL UNIT SITUATED ON THE SURFACE

The present invention relates to a telemetry system for the bi-directional communication of data between a well point and a terminal unit situated on the surface.

In the oil industry there is great interest for communication systems which are capable of transmitting well bottom data to the surface in real time and with a high capacity.

This connection is ideally possible contemporaneously with the drilling and therefore in the presence of the circulation of sludge. The latter moves inside the drilling string as far as the bit from where it returns to the surface, flowing in the well section outside the string; sludge is necessary for various reasons among which the removal of drilling cuttings from the well, the reduction of friction caused by the string inside the well, hydrostatic balancing, etc.

It is known that the approach most frequently used at present in the oil industry for data transmission from the well bottom is based on the modulation of the sludge flow pressure. This method obviously has considerable limitations in terms of channel capacity which can reach a few bit/s at the most.

For the high capacity transmission of digital data from the well bottom, it is possible to use an electric cable or optical fibre situated inside the drilling string. This cable is typically of the armored type for resisting environmental conditions, i.e. for example stress caused by the flow of sludge inside the string necessary during drilling. This approach cannot currently be adopted due to the necessity in drilling of successively screwing together all the pipes forming the string. The cable should therefore be disconnected each time a new section of the drilling string is added and substituted with a longer cable. Alternatively it could be possible to splice a part of the cable each time a section of string is added, but this not only implies a considerable waste of time, but also serious problems relating to reliability due to the hundreds of joints necessary for reaching the desired well depth. A further approach could consist of a cable, run by a winch, which would be wound and unwound for each section added and which should be re-connected to the well bottom after the insertion of each section. This second solution is again practically impossible as a result of the prolonging of the drilling times and impact on the logistics caused by the space required by said winch, close to the drilling equipment.

Various attempts have been made in the past for finding an acceptable solution, among which the use of a cable situated inside the string and overlapping with the use of a pair of pulleys for lengthening it. This approach does not generally guarantee the desired lengthening and is practically unusable as a result of the flow of sludge which tends to block the running of the pulleys.

Another approach is based on the use of conductors situated inside the wall of the drilling pipes. Each section is consequently provided with suitable connectors which are coupled with the adjacent sections in order to supply the transmission channel. The disadvantages of this approach consist in the necessity for special and consequently costly drilling pipes and in the poor reliability of the channel produced with the use of hundreds of connections.

An approach based on the use of a non-armored optical fibre bobbin which cannot be re-used, situated near the upper end of the string, has recently been proposed. One end of the optical fibre contained in said bobbin is connected to the well bottom instrumentation, whereas the other end is connected to the surface reception system by means of a stinger connected with a radio transmission system. In order to allow sections of string to be added, the bobbin and stinger are lowered into the string for the length of a section and then blocked; after the insertion of the new section, the bobbin is brought back to the upper end of the string and the fibre is contemporaneously unwound from said bobbin. The main disadvantage of this approach lies in the use of a non-armored fibre which is required for enabling the use of a bobbin which is sufficiently small as to allow the passage of sludge. It is known that this type of fibre does not cover the functioning duration required in current drilling operations. Furthermore, the connection of the string sections would require manual operations on the part of the drilling staff, consequently lengthening the times and creating the possibility of errors on the part of the operators.

Furthermore, in patent application GB-2370590 (published on Mar. 7, 2002), an approach is presented, which comprises the use of a bobbin at the well bottom from which the necessary quantity of cable is unwound, for allowing the extension of the drilling string. In our opinion, this approach has great disadvantages due to the friction of the cable along the internal surface of the pipes, making their practical application on long strings impossible.

The object of the present invention relates to a communication system to be used inside drilling strings, which is bi-directional, has a high channel capacity and can also be used during drilling operations, based on the use of a line which can contain electric conductors and/or one or more optical fibres, unwound by an active vehicle, i.e. equipped with locomotion devices, or a passive vehicle, moved by means of a cable activated by a suitable winding/unwinding device.

This communication system allows, for example, a device situated close to the drilling bit to be connected with a terminal unit situated on the surface close to the drilling equipment.

The numbers appearing beside the elements of the system claimed referring to the enclosed figures are solely provided for a better understanding of the invention which should in no way be considered as being limited by said figures.

The telemetry system, object of the present invention, for bi-directional data communication between a well point and a terminal unit on the surface (A), which can be used inside drilling or production strings, comprises:

- data transmission and optional reception devices;
- an active vehicle (8), which can be equipped with various automation levels, ranging from purely tele-operated to completely autonomous, for unwinding and pulling a connection line, capable of moving inside the drilling or production string, or a passive vehicle (E), moved by means of a deploying cable and a suitable winding/unwinding device, in particular a winch;
- a connection line (9), containing electric conductors and/or one or more optical fibres, of the transmission and optional reception devices between a well point and its corresponding point situated inside the vehicle or on the surface;
- optionally, in the case of drilling strings, also a garage (3) for housing the active vehicle or for housing the passive vehicle together with the winding/unwinding device, which allows the free circulation of the sludge and contemporaneous protection of said vehicle.

In the case of drilling strings, the well point for communicating data is normally the well bottom (B) and the connecting line (9) preferably connects the transmission and optional reception devices between the well bottom (B) and its corresponding point situated inside the vehicle.

The connection between the corresponding point of the well, situated inside the vehicle, and the terminal unit (A) on the surface, can be effected by means of an RF (radio-frequency) or optical or acoustic system or by means of wiping contacts.

In the case of production strings, the connection line (9) normally connects the transmission and optional reception devices between a well point (B) and its corresponding point situated on the surface (A).

The active vehicle (8), which can be equipped with various automation levels, ranging from purely tele-operated to completely autonomous, capable of moving inside pipes for unwinding and pulling a connection line (9) containing electric conductors and/or one or more optical fibres which allows the transmission and optional reception of data, can consist of:

- a winch (19) of the line to be unwound or pulled;
- means for supplying electric energy to said vehicle (18);
- electronic control and communication devices (16);
- locomotion devices for the movement inside the pipe;
- anchoring devices (17) for guaranteeing safe stoppage inside the pipe.

The passive vehicle (E) for unwinding and pulling a connection line (9) containing electric conductors and/or one or more optical fibres which allows the transmission and optional reception of data, can consist of:

- a winch (19) of the line to be unwound or pulled;
- means for supplying electric energy to said vehicle;
- electronic control and communication devices;
- anchoring devices (17) for guaranteeing safe stoppage inside the pipe, the vehicle being connected, by means of a detachable deploying cable (G) and an hooking/unhooking device (F), to a suitable winding/unwinding device (D), in particular a winch, which can be situated inside the possible "garage" or outside the string.

The use of the active vehicle or passive vehicle enables all the problems mentioned above to be overcome and, in particular, allows the use of both cables made of bare fibre and cables made of armored fibre and also electric cables, capable of resisting environmental conditions for the time necessary for the drilling, and also avoiding any kind of interaction with the drilling operations.

The above line is preferably wound onto a bobbin which, in the case of drilling strings, can be situated in the lower part of the vehicle.

The electric power supply means in the active vehicle or passive vehicle can be batteries or they can consist of the connection line itself.

Furthermore, there can also be a head connector (11) in said active or passive vehicle, for connecting the vehicle itself to a garage when the vehicle is housed therein.

- in the case of an active vehicle, the connection only occurs when the garage is housing the vehicle itself;
- in the case of a passive vehicle, the connection occurs when the hooking/unhooking device (F) is put in contact with said connector (11), which, only in this case, also acts as a support for the vehicle itself.

It is known to experts in the field that said connector can be of the type "with no contacts", for example with magnetic induction, in order to facilitate connections also in the presence of water and sludge.

The active vehicle according to the invention can also optionally have other functions such as inspections, workover operations, substitution of parts: in this case, there are measurement and detection devices, means for taking television and/or acoustic images, for activating devices, moving parts.

As mentioned above, in the case of drilling strings, there can also be a garage for housing the active vehicle or passive vehicle which allows the free circulation of the sludge and contemporaneous protection of said vehicle.

The garage for housing an active vehicle or a passive vehicle, which represents a further object of the present invention, is installed under a top drive (1) and screwed to a drilling string (2) and comprises, from the inside to the outside, a suitable container substantially cylindrically-shaped and truncated-conical at the joints (10), in which said vehicle can be inserted, and a wall substantially cylindrically-shaped and truncated-conical at the joints, which forms a space between said container and the wall of the garage allowing the free circulation of the drilling sludge, said substantially cylindrically-shaped container being maintained in an appropriate position by means of supports (C).

The garage can also optionally contain:

- RF (radio-frequency) communication or optical or acoustic devices;
- batteries (5) which store energy for the vehicle housed therein;
- means of connection with the housed vehicle;
- in the case of a passive vehicle a winch and cable for moving the vehicle, in which a suitable hooking/unhooking device for hooking/unhooking the vehicle can be situated at the end of the cable.

The power in the garage can also be supplied by means of an electric cable coming from the top drive, optionally by means of the use of wiping contacts.

A further object of the present patent application relates to the process for inserting a new section of drilling string, when an active vehicle is used, which comprises the following steps:

- suspension of the flow of sludge;
- exit of an active vehicle from a housing garage and insertion of said vehicle in the last inserted string section;
- insertion of the new string section;
- return of the vehicle to the garage with the contemporaneous unwinding and pulling of the line;
- clamping of the connection screw threads and reactivation of the flow of sludge.

A further object of the present patent application relates to the process for the insertion of a new drilling string section, when a passive vehicle is used, which comprises the following steps:

- suspension of the flow of sludge;
- lowering of the vehicle, hung to the hooking/unhooking device at the end of the cable unwound by the winch situated inside the garage, into the last inserted string section, release of the unhooking device and recovery of said device with the winch;
- insertion of the new string section;
- return of the vehicle to the garage using the cable unwound by the winch and the hooking/unhooking device situated at the end of said cable;
- clamping of the connection screw threads and reactivation of the flow of sludge.

With the help of FIGS. 1, 2, 3, 4, 5 and 6, an embodiment, according to the invention is provided, of the system, the active vehicle, the passive vehicle, the garage and the processes for inserting a new section of drilling strings.

Figure 1:
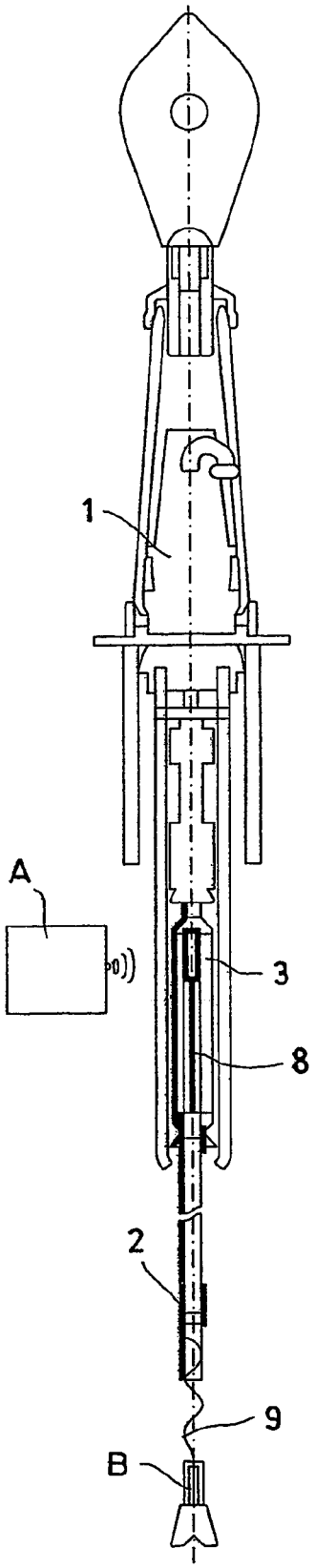
FIG. 1 represents an embodiment of the telemetry system.
Figure 2:
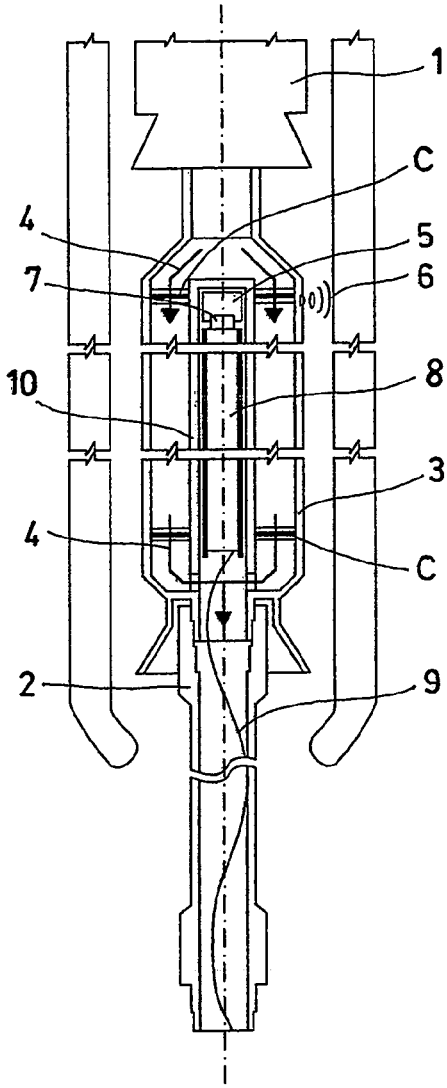
FIG. 2 represents a section of the most important components of the telemetry system.
Figure 3:
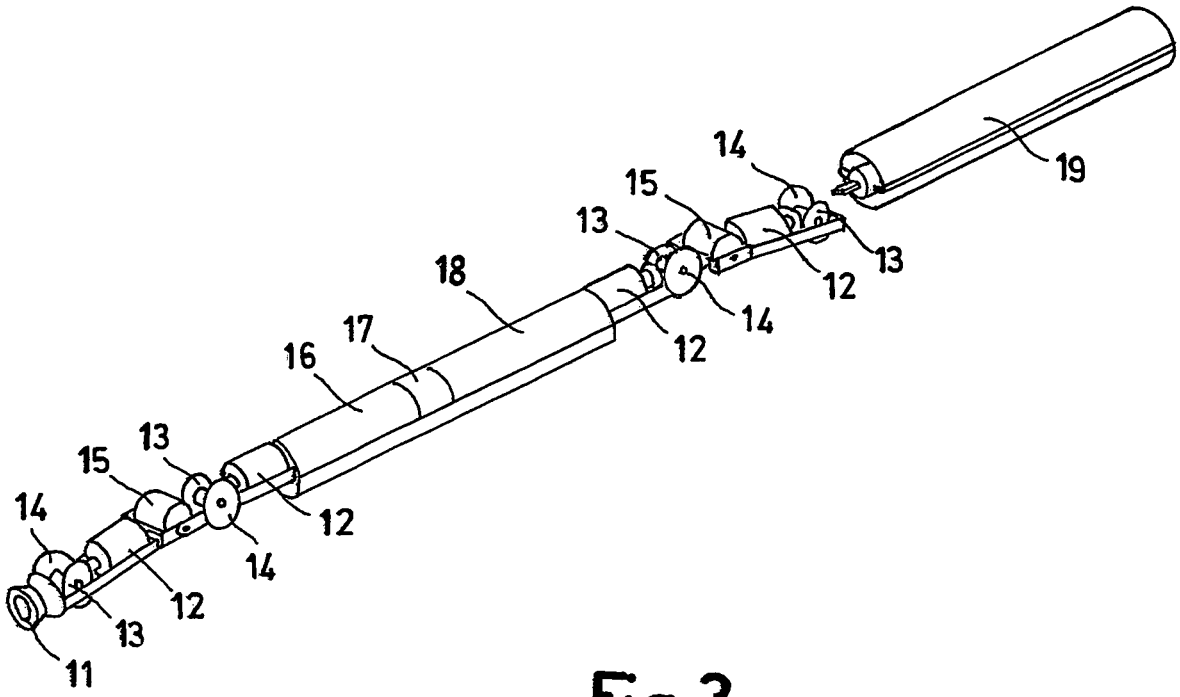
FIG. 3 represents an embodiment of the active vehicle.
Figure 4:
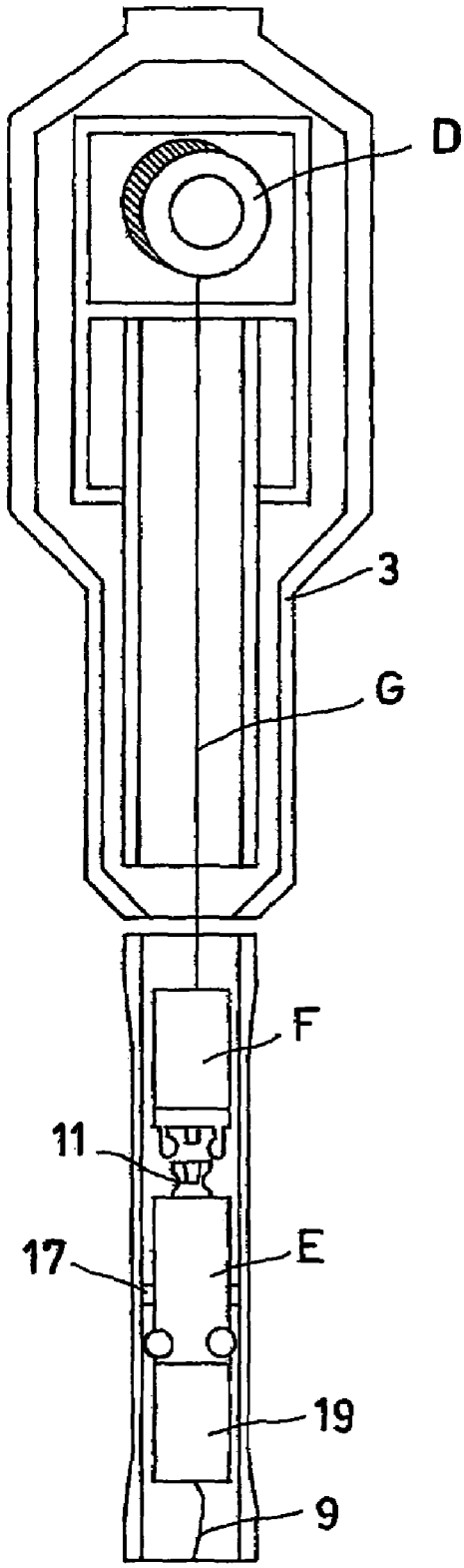
FIG. 4 represents an embodiment of the system which comprises the passive vehicle, i.e. without locomotion devices, and a suitable cable and winch suitable for moving said vehicle.
Figure 5:
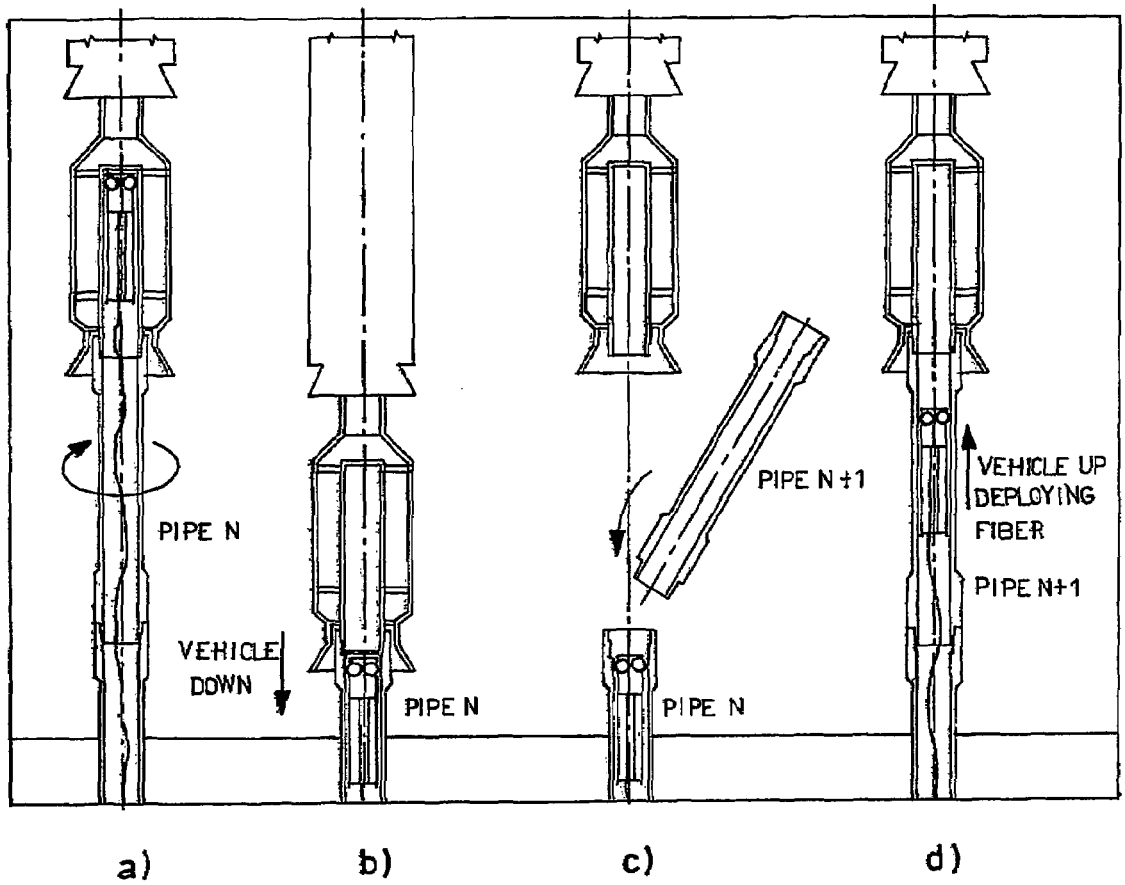

FIG. 5 schematizes the main process phases for the insertion of a new section of drilling string when an active vehicle is used.

Figure 6:
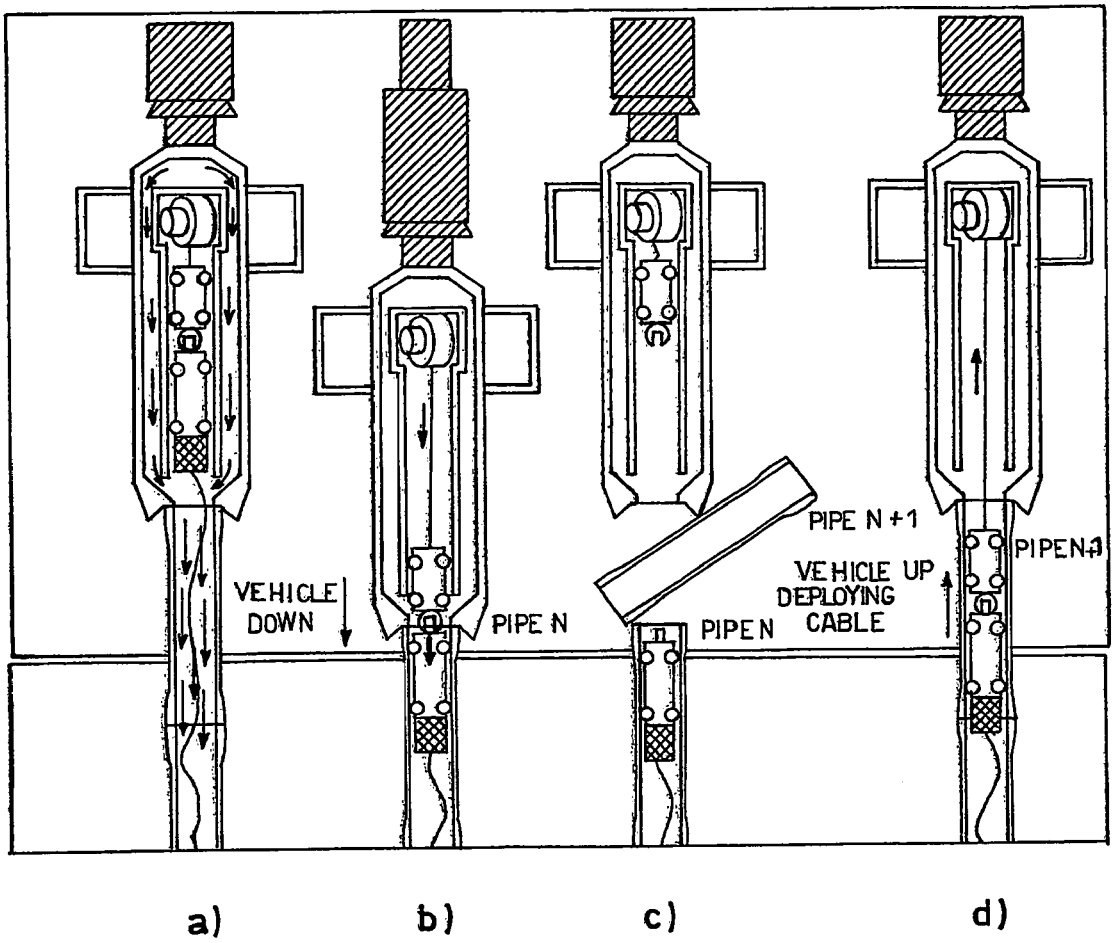

FIG. 6 schematizes the main process phases for the insertion of a new section of drilling string when a passive vehicle is used.

During the drilling phases, the active vehicle (8) is situated inside a garage (3), installed under the top drive (1) and screwed to the normal drilling string (2).

Inside the garage there is a suitable container (10), maintained in an appropriate position by supports (C), into which the vehicle can be inserted. The space between said container and the internal wall of the garage allows the free circulation of the drilling sludge (4). Furthermore, the garage can house a main battery (5) which preserves the quantity of energy required for all the necessary operations. In another embodiment, the battery is eliminated and substituted by a rotating connector which allows the direct connection of the vehicle batteries to a battery charging system fed by the electric network.

When the vehicle is passive, the garage also houses a winch (D) and cable (G) having a hooking/unhooking device (F) at its end for moving said vehicle.

During the normal drilling phase, the line (9) is extended inside the string, connecting the transmission/reception system at the well bottom (B) with its symmetrical point contained in the vehicle. A coupling of the type with no contacts (7) (for example of the induction type) and a radio connection (6) complete the high velocity communication equipment in real time between the well bottom device and the surface terminal (A).

Alternatively, it is possible to substitute the radio connection with electric conductors or optical fibre and a rotating connector, for example consisting of wiping contacts, in order to ensure the connection between the garage which rotates and data terminal which is fixed.

The addition of a new section of string, when an active vehicle (8) is used, can be effected by means of the following procedure:

- the flow of sludge is suspended as usual to allow the insertion of the new section of string (FIG. 5*a*);
- a command is sent to the vehicle to leave the garage (3) and enter the last inserted section of string (PIPE n) (FIG. 5*b*);
- the new section of string is connected (PIPE n+1) according to the normal procedure (FIG. 5*c*);
- a command is sent to the vehicle to return to the garage (FIG. 5*d*) and during this movement the vehicle releases the appropriate length of line, in order to keep the line correctly stretched;
- after the clamping of the connection screw threads, the flow of sludge can be re-activated and the drilling procedure re-started.

The command to the active vehicle can be communicated by means of a radio frequency connection between the garage and vehicle, or with other means such as optical or ultrasonic communications.

The addition of a new section of string, when a passive vehicle (E) is used, can be effected by means of the following procedure:

- the flow of sludge is suspended as usual to allow the insertion of the new section of string (FIG. 6*a*);
- lowering of a vehicle, hung to a hooking/unhooking device (F) at the end of the cable (G) unwound by a winch (D) situated inside a garage (3), into the last inserted string section (PIPE n), release of the unhooking device and recovery of said device with the winch (FIG. 6*b*);
- the new section of string is connected (PIPE n+1) according to the normal procedure (FIG. 6*c*);
- the passive vehicle is hooked by the hooking/unhooking device (F) at the end of the cable (G) run by a winch (D) situated inside the garage (3) and is hoisted back into said garage (FIG. 6*d*);
- after the clamping of the connection screw threads, the flow of sludge can be re-activated and the drilling procedure re-started.

The recovery phase of the string and consequently the dismantling of the pipe forming the string, can be effected inversely to what is indicated above, commanding the active vehicle to descend or by lowering the passive vehicle into the section to be dismantled, with the contemporaneous rewinding of the suitable length of line.

Alternatively, considering the low cost of the connection line with respect to the operating cost of the drilling plant, said line can be eliminated by extracting the active or passive vehicle from the string and using a winch on the surface together with a device for cutting the cable situated close to the communication devices at the well bottom.

In another possible embodiment of the invention, the active or passive vehicle is equipped with an additional mechanical function which allows it to eject the section of cable recovered from the upper end of the vehicle itself. The part of the cable thus ejected is cut manually by the drilling operators or automatically by the vehicle itself.

In another possible embodiment of the invention, a container, which is sufficiently long for containing the line which is to be removed, is lowered into the upper end of the string. Said container is then pushed by the flow of sludge and/or by its own weight in the direction of the lower end, collecting inside all of the unwound cable in the string. The container stops at the lower end of the string, where there is a suitable blocking device. Said block can be appropriately designed by experts in the field for allowing the free circulation of the sludge and recovery of the container from the surface using means and devices known in the state of the art.

The active vehicle can be remote-controlled, as described above, or completely autonomous, i.e. capable of effecting all the procedures on the basis of a program memorized in the on-board computer and the data coming from suitable sensors.

The active vehicle consists of the line winch (19), batteries (18), control and communication electronics (16), locomotion unit, blockage unit (17) and head connector (11).

In another possible embodiment, the vehicle is passive (E), i.e. without any locomotion unit: in this case, the movement is guaranteed by a winch (D), situated inside the garage (3), and a cable (G) which can have a hooking/unhooking device (F) at the end.

The batteries in the vehicle (active or passive) do not require a great capacity, as during the drilling and rod assembly/dismantling cycle, the vehicle remains inside the garage for a long time, where it receives electric power from the connector.

The winch is capable of unwinding the line (19), keeping a suitable tension. The winch can also either partially or totally re-wind the line previously unwound, constantly maintaining a suitable tension. Experts in the field can clearly understand that the winch can be produced on the basis of known techniques, for example by using a cylinder onto which the line is wound, driven by a controlled motor in order to produce for example a constant, pre-established couple, suitable for maintaining the correct tension of the line. The winch may also comprise a distributor in order to guarantee an orderly unwinding/rewinding of the line.

In a particular embodiment of the invention relating to the use of an active vehicle, the locomotion unit consists of a motor (12), suitable gears (13) and a wheel (14) which presses against the internal surface of the pipe. In this embodiment, the pair of wheels are forced against the surface of the pipe by means of a spring (15). In another embodiment, crawlers are used which are forced on opposite surfaces of the pipe by means of springs. In a further embodiment, a clamping system is used, which expands and is fixed to an internal point of the pipe, together with a moving system which causes the vehicle to slide with respect to the clamp. When the end of the run of said movement is reached, a second clamping system is activated and the first is deactivated, thus allowing movement for the subsequent advancing of the vehicle. Experts in the fields can clearly understand that, in the state of the art, there are many possible functioning means for movement inside the pipes and that all of these are included in the scope of the present invention.

The blockage unit guarantees the safe stoppage of the vehicle inside the pipe. This stoppage may be necessary for deactivating the locomotion system when the vehicle is at a standstill for a long time in order to reduce using up the batteries, and for general safety in the case of malfunctioning.

The invention claimed is:

1. A telemetry system for bi-directional communication of data between a well point and a surface terminal unit, configured to be used inside drilling or production strings, comprising:

data transmission and optional reception devices;

an active vehicle, configured to be equipped with plural automation levels, ranging from purely tele-operated to completely autonomous, for unwinding and pulling a connection line from the vehicle, configured to move inside the drilling or production string, or a passive vehicle, moved by a deploying cable and a winding/unwinding device, the passive vehicle including a winch configured to unwind or pull the connection line from the vehicle, means for supplying electric energy to the vehicle, electronic control and communication devices, and anchoring devices configured to guarantee safe stoppage inside the pipe, wherein the vehicle is connected, by the deploying cable and a hooking/unhooking device, to the winding/unwinding device, and is configured to be situated inside a garage or outside the string; and a connection line, containing electric conductors and/or one or more optical fibers, of the transmission and optional reception devices between the well point and its corresponding point situated inside the vehicle or on the surface.

2. The telemetry system according to claim 1, wherein, in a case of drilling strings, the well point for communicating data is a well bottom.

3. The telemetry system according to claim 1, wherein, in a case of drilling strings, the garage is configured to house the active vehicle or to house the passive vehicle together with the winding/unwinding device, which allows free circulation of sludge and contemporaneous protection of the vehicle.

4. The telemetry system according to claim 1, wherein, in a case of drilling strings, the connection line connects the transmission and optional reception devices between a well bottom and its corresponding point inside the vehicle.

5. The telemetry system according to claim 4, wherein the connection between the corresponding well point, situated inside the vehicle, and the surface terminal unit is effected by an RE (radio-frequency), or acoustic, or optical system.

6. The telemetry system according to claim 4, wherein the connection between the corresponding well point, situated inside the vehicle, and the surface terminal unit is effected by wiping contacts.

7. The telemetry system according to claim 1, wherein, in a case of drilling strings, the connecting line connects the transmission and optional reception devices between a well point and its corresponding point situated on the surface.

8. The telemetry system according to claim 1, wherein the garage is installed under a top drive and screwed to a drilling string, and the garage includes from inside to outside a container substantially cylindrically-shaped and truncated-conical at joints, in which the vehicle can be inserted, and a wall substantially cylindrically-shaped and truncated-conical at the joints, which forms a space between the container and the wall of the garage allowing free circulation of drilling sludge, the substantially cylindrically-shaped container being maintained in a desired position by supports.

9. The telemetry system according to claim 8, wherein the garage includes RF (radio-frequency) communication, or optical or acoustic systems.

10. The telemetry system according to claim 8, wherein the garage includes batteries configured to store energy for the housed vehicle.

11. The telemetry system according to claim 10, wherein the stored energy is supplied by an electric cable coming from the top drive, by use of wiping contacts.

12. The telemetry system according to claim 8, wherein the garage includes connection devices with the housed vehicle.

13. A process for recovery of the connection line of the system according to claim 1, in a recovery phase of the string and consequently dismantling of the pipe forming the string, by commanding the active vehicle to descend or by lowering the passive vehicle into a section to be dismantled, with contemporaneous rewinding of a suitable length of connection line.

14. A process for elimination of the connection line of the system according to claim 1, by extracting the active or passive vehicle from the string and using a winch on the surface together with a device for cutting the cable situated close to the communication devices at a well bottom.

15. A process for elimination of the connection line of the system according to claim 1, in a recovery phase of the string and consequently dismantling of the pipe forming the string, effected by the active or passive vehicle equipped with an additional mechanical function that allows the vehicle to eject a section of the cable recovered from an upper end of the vehicle itself, the part of the cable thus ejected being cut by the drilling operators or automatically by the vehicle itself.

16. A process for elimination of the connection line of the system according to claim 1, by a container, which is sufficiently long for containing the line to be removed, lowered into an upper end of the string, the container being subsequently pushed by the flow of sludge and/or by its own weight in a direction of a lower end of the string, collecting inside all of the unwound cable in the string, the container stopping at the lower end of the string, where there is a blocking device.

17. An active vehicle, capable of moving inside pipes for unwinding and pulling a connection line containing electric conductors and/or one or more optical fibers configured to allow transmission and optional reception of data, comprising:

a winch configured to unwind or pull the connection line from the vehicle;

a head connector;

means for supplying electric energy to the vehicle;

electronic control and communication devices;

locomotion devices for movement inside the pipe; and anchoring devices configured to guarantee safe stoppage inside the pipe.

18. The active vehicle according to claim 17, wherein the locomotion devices include a motor, gears, and at least one wheel that presses against an internal surface of the pipe and is forced by a spring.

19. The active vehicle according to claim 17, wherein the vehicle is equipped with plural automation levels, ranging from purely tele-operated to completely autonomous.

20. A passive vehicle for unwinding and pulling a connection line containing electric conductors and/or one or more optical fibers configured to allow transmission and optional reception of data, comprising:

a winch configured to unwind or pull the connection line from the vehicle;

means for supplying electric energy to the vehicle;

electronic control and communication devices; and anchoring devices configured to guarantee safe stoppage inside the pipe, wherein the vehicle is connected, by a detachable deploying cable and a hooking/unhooking device, to a winding/unwinding device, configured to be situated inside a garage or outside a drilling string.

21. The vehicle according to claim 20, wherein the means for supplying electric power comprises batteries.

22. The vehicle according to claim 20, wherein the means for supplying electric power comprises the connection line itself.

23. The vehicle according to claim 20, further comprising a head connector configured to connect the vehicle itself to a garage for housing the vehicle.

24. The vehicle according to claim 20, further comprising:

measurement and detection devices;

transmitting devices of television and/or acoustic images;

means for activating devices;

devices for moving parts.

25. A process for insertion of a new section of drilling string when an active vehicle is used, the process comprising:

suspending a flow of sludge;

exiting an active vehicle from a housing garage and inserting the vehicle in a last inserted string section;

inserting a new string section;

returning the vehicle to the garage with contemporaneous unwinding and pulling of a line such that the line is unwound or pulled from the active vehicle; and clamping connection screw threads and re-activating of the flow of sludge.

26. A process for insertion of a new section of drilling string when a passive vehicle is used, the process comprising:

suspending a flow of sludge;

lowering a passive vehicle, hung to a hooking/unhooking device positioned at an end of a cable unwound by a winch situated inside a garage, into a last inserted string section, releasing the hooking/unhooking device and recovering the vehicle with the winch;

inserting a new string section;

hooking the passive vehicle by the hooking/unhooking device positioned at an end of the cable run by the winch situated inside the garage and hoisting the vehicle back into the garage such that a connection line is unwound or pulled from the vehicle; and clamping connection screw threads and re-activating the flow of sludge.

27. A telemetry system for bi-directional communication of data between a well point and a surface terminal unit, configured to be used inside drilling or production strings, comprising:

data transmission and optional reception devices;

an active vehicle, configured to be equipped with plural automation levels, ranging from purely tele-operated to completely autonomous, for unwinding and pulling a connection line from the vehicle, configured to move inside the drilling or production string, or a passive vehicle, moved by a deploying cable and a winding/unwinding device, wherein the active or passive vehicle includes a winch configured to unwind or pull the line from the vehicle, means for supplying electric energy to the vehicle, electronic control and communication devices, anchoring devices configured to guarantee safe stoppage inside the pipe, and only for the active vehicle, locomotion devices to allow movement inside the pipe; and a connection line, containing electric conductors and/or one or more optical fibers, of the transmission and optional reception devices between the well point and its corresponding point situated inside the vehicle or on the surface.

* * * * *